US010857543B2

(12) United States Patent
Hoffmann

(10) Patent No.: US 10,857,543 B2
(45) Date of Patent: Dec. 8, 2020

(54) PIVOTING JAR MILL WITH ROTATING DISCHARGE GRATE

(71) Applicant: Aaron Engineered Process Equipment, Inc., Bensenville, IL (US)

(72) Inventor: Jeffrey R. Hoffmann, Schaumburg, IL (US)

(73) Assignee: AARON ENGINEERED PROCESS EQUIPMENT, INC., Bensenville, IL (US)

( * ) Notice: Subject to any disclaimer, the term of this patent is extended or adjusted under 35 U.S.C. 154(b) by 237 days.

(21) Appl. No.: 15/728,134

(22) Filed: Oct. 9, 2017

(65) Prior Publication Data

US 2019/0105659 A1 Apr. 11, 2019

(51) Int. Cl.

| | |
|---|---|
| ***B02C 17/00*** | (2006.01) |
| ***B02C 17/18*** | (2006.01) |
| ***B02C 17/04*** | (2006.01) |

(52) U.S. Cl.

CPC ..... *B02C 17/1855* (2013.01); *B02C 17/04* (2013.01); *B02C 17/18* (2013.01); *B02C 17/182* (2013.01)

(58) Field of Classification Search

CPC ..... B02C 17/1855; B02C 17/04; B02C 17/18; B02C 17/181; B02C 17/182; B02C 17/1835; B02C 17/184

USPC ..... 241/22

See application file for complete search history.

(56) References Cited

U.S. PATENT DOCUMENTS 1,517,538 A * 12/1924 Daman ..... B02C 17/181 241/177
2,020,091 A * 11/1935 Abbe ..... B02C 17/04 215/283
2,042,254 A * 5/1936 Godinez ..... B02C 17/16 241/44

(Continued)

OTHER PUBLICATIONS

"What is Ultra High Molecular Weight Polyethylene? (UHMWPE). ", Fluorocarbon, Sep. 2016, http://www.fluorocarbon.co.uk/news-and-events/post/18/what-is-ultra-high-molecular-weight-polyethylene-uhmwpe (Year: 2016).*

(Continued)

*Primary Examiner* — Adam J Eiseman
*Assistant Examiner* — Dylan Schommer
(74) *Attorney, Agent, or Firm* — Barnes & Thornburg LLP; G. Peter Nichols

(57) ABSTRACT

A rotary milling system includes a body rotatable about its longitudinal axis and pivotable about a pivot axis that is transverse to the longitudinal axis. The system includes an interchangeable discharge grate and a solid cover for attaching to an open end of the body. The discharge grate includes a plurality of holes through which milled product can pass while grinding media is retained. The body is pivotable to a vertical orientation, where the covers can be changed, and to a horizontal orientation where grinding can be performed with the solid cover attached or discharge can be performed with the discharge grate attached. The discharge grate is sealed to a discharge housing during discharge via an annular seal, where the discharge grate and body are rotated relative to the fixed discharge housing. The discharge grate can include a deflector portion that deflects milled product away from the annular seal.

15 Claims, 5 Drawing Sheets

(56) References Cited

U.S. PATENT DOCUMENTS

| | | | | |
|---|---|---|---|---|
| 2,670,139 | A * | 2/1954 | Treshow | B02C 17/04 241/70 |
| 3,001,730 | A * | 9/1961 | Daman | B02C 17/18 241/183 |
| 3,231,203 | A * | 1/1966 | Hardinge | B02C 17/1845 241/24.1 |
| 6,405,952 | B1 * | 6/2002 | Zoz | B02C 17/16 241/172 |
| 9,283,565 | B2 * | 3/2016 | Greenwood | B02C 17/181 |
| 2016/0250647 | A1 * | 9/2016 | Hoffmann | B02C 17/10 241/46.06 |

OTHER PUBLICATIONS

"Pivoting Jar Mills.", Paul O. Abbe, Paul O. Abbe, Jul. 30, 2012, https://www.pauloabbe.com/size-reduction/pivoting-jar-mills (Year: 2012).*

RetschHQ, Drum Mill TM 300 XL—Retsch, Jun. 7, 2016, Youtube, https://www.youtube.com/watch?v=xOpohwX51Bk (Year: 2016).*

* cited by examiner

PIVOTING JAR MILL WITH ROTATING DISCHARGE GRATE

BACKGROUND

The present invention relates to jar mills. More particularly, the invention relates to a pivoting jar mill that rotates relative to a dry discharge housing.

Rotary mills, also known as ball mills, pebble mills, rod mills, or tumble mills, are well known in the art. Jar mills are one type of rotary mill that are generally smaller that a traditional rotary mill. Jar mills are typically cylindrical in shape, having a cylinder shaped housing. The cylinder is typically arranged such that the axis of rotation of the housing is horizontal. The housing is traditionally supported by a pair of rollers that are coupled to a driving member that will rotate the rollers, thereby rotating the jar mill that is supported on the rollers. In another approach, the cylinder can be bolted or otherwise secured to a frame that is rotatably driven.

The cylinder includes grinding media that is generally spherical, cylindrical, or another shape. In the case of dry milling, the solid target materials are placed in the cylinder to be ground by the grinding media. The cylinder is rotated, causing the grinding media to tumble along with the target material, with the grinding media abrading and impacting the solid target materials. Continued rotation of the cylinder produces a milled product in the form of particles. In the case of dry milling, the particles settle within the cylinder and between the grinding media.

The mill includes an opening with a solid cover. Grinding media and the target material are loaded into the cylinder through the opening, and the solid cover is secured over the opening to seal the cylinder. The cylinder can then be loaded onto the rollers or secured to the rotatable frame.

Upon completion of the milling process, the milled product is discharged from the cylinder. One method of discharge is known as dumping, and includes opening the solid cover of the cylinder and the milled solids and grinding media are dumped from the mill together out of the opening. The milled solids can then be separated with an ancillary device such as a stationary grate, vibrating sifter, or the like. Jar mills, being relatively small, can be lifted by hand and dumped. Separation of the milled product and the grinding media can be performed via a grate, or can be separated manually, by removing the grinding media. For larger jar mills that cannot be lifted by hand, the cylinder may be pivoted in the frame by hand.

However, dumping the grinding media and milled product to recover the milled product and separate the milled product from the grinding media exposes the operator to the fine dust that is generated by the milling process. This dust can be approximately 1 to 20 microns in size.

Upon completion of the recovery and separation of the milled product from the grinding media, the grinding media must be reloaded into the mill manually.

Retrieval of the milled product from the discharge housing can also result in milled product entering the surrounding area. These conditions can reduce the amount of milled product recovered and cleaning problems, as well as undesirable exposure of the fine dust to the operator.

Thus, there is a need for a jar mill system that can reliably deliver the milled product from the cylinder.

SUMMARY

A rotary milling system for using grinding media to create a milled product includes a rotatable body having a sidewall extending between first and second ends thereof, a first end wall at the first end, and an opening at the second end, the body defining a cavity and a central longitudinal axis, the rotatable body configured to retain grinding media therein.

A discharge grate is detachably mounted to the second end of the body, the discharge grate covering the opening when mounted to the second end and rotationally fixed to the body. A plurality of holes pass through the discharge grate and are configured to retain grinding media within the cavity of the body while allowing milled product to pass through the holes. A discharge housing is attached to the discharge grate, wherein the discharge grate is rotatable relative to the discharge housing when the body is rotated about the longitudinal axis.

The rotatable body is selectively rotatable about the longitudinal axis and selectively pivotable about a pivot axis that extends transverse to the longitudinal axis. The rotatable body has a first orientation and a second orientation, the second orientation being pivoted about the pivot axis relative to the first orientation such that the opening is disposed upward relative to the first orientation.

In one form, the longitudinal axis is horizontal in the first orientation and vertical in the second orientation. The discharge housing and discharge grate may define an annular seal. In one form the seal is an ultra-high molecular weight (UHMW) labyrinth seal. The discharge housing may remain fixed during rotation of the body and discharge grate.

The system may further include a removable solid cover, where the solid cover is attached to the body and covers the opening when the discharge grate is removed. The system may further include a support yoke attached to the rotatable body on opposite sides thereof. The system may further include a drive shaft and a motor, where the drive shaft is coupled to the motor for being rotational driven and coupled to the yoke, where rotation of the drive shaft rotates the yoke and the body attached thereto. The yoke may be attached to the body via rotational bearings on opposite sides of the body, and the rotational bearings define the pivot axis such that the body is pivotable relative to the yoke. At least one of the rotational bearings can be coupled to a gear reducer, wherein actuation of the gear reducer rotates the body about the pivot axis.

In one form, the plurality of holes are disposed in a radially outer portion of the discharge grate. In a further approach, the discharge grate includes a deflector portion that extends longitudinally outward from the discharge grate away from the body, the deflector portion having an annular shape and disposed at a radially outward portion of the discharge grate and radially outward from the plurality of holes, wherein the deflector portion is disposed radially between the plurality of holes and an attachment interface defined between the discharge housing and the discharge grate for deflecting milled product away from the attachment interface. The deflector portion may have a tapered profile, such that a height of the deflector portion from discharge grate is greater at a radially outward location than at a radially inward location.

In one approach, the discharge housing is biased against the discharge grate. In one form, the discharge grate includes a shaft extending longitudinally away from the discharge grate, the discharge housing includes a bushing, the shaft extends through the bushing, and a spring extends between the shaft and the bushing to bias the bushing toward the discharge grate.

In another form, the sidewall has a tapered shape such that a diameter of the body at the end wall is smaller than the diameter of the opening, wherein rotation of the body about the longitudinal axis urges milled product toward the opening.

In one embodiment, a rotary milling system for using grinding media to create a milled product includes a rotatable body having a tapered sidewall extending between first and second ends thereof, an end wall at the first end, and an opening at the second end, the body defining a cavity and a central longitudinal axis, the rotatable body configured to retain grinding media therein, wherein a diameter at the opening is greater than a diameter at the end wall.

The system has a first configuration including a solid cover mounted to the second end of the body and covering the opening. The system has a second configuration including a discharge grate mounted to the second end of the body, the discharge grate covering the opening when mounted to the second end and rotationally fixed to the body, a plurality of holes passing through the discharge grate and configured to retain grinding media within the cavity of the body while allowing milled product to pass through the holes, and a discharge housing attached to the discharge grate, wherein the discharge grate is rotatable relative to the discharge housing when the body is rotated about the longitudinal axis.

The rotatable body is pivotable about a pivot axis that is perpendicular to the longitudinal axis, the body being pivotable between a longitudinal horizontal orientation and a longitudinal vertical orientation. The rotatable body is rotatable about the longitudinal axis in the horizontal orientation in the first configuration to perform a grinding operation and in the second configuration to perform a discharge operation. In the vertical orientation, the system is convertible between the first configuration and the second configuration.

In one form, the discharge grate is sealed with the discharge housing in the second configuration via an annular seal, and the body and discharge grate are rotatable in the horizontal orientation relative to the discharge housing, and the discharge housing remains fixed.

In another embodiment, a method of operating a media grinding and discharge system is provided. The system includes a rotatable body having a sidewall extending between first and second ends thereof, an end wall at the first end, and an opening at the second end, the body defining a cavity and a central longitudinal axis, the rotatable body configured to retain grinding media therein, wherein the body is pivotable about a pivot axis that is perpendicular to the longitudinal axis, the body being pivotable between a longitudinal horizontal position and a longitudinal vertical position.

The method includes pivoting the body to the vertical position and in response thereto, mounting a solid cover to the second end and covering the opening. In response to mounting the solid cover, the method includes pivoting the body to the horizontal position, and in response thereto, rotating the body about the longitudinal axis to perform a grinding operation.

The method further includes, in response to performing the grinding operation, pivoting the body to the vertical position and removing the solid cover. The method further includes mounting a discharge grate to the second end after removing the solid cover, the discharge grate covering the opening when mounted to the second end and rotationally fixed to the body, wherein the discharge grate includes a plurality of holes passing through the discharge grate and configured to retain grinding media within the cavity of the body while allowing milled product to pass through the holes.

The method includes attaching a discharge housing to the discharge grate, wherein the discharge grate is rotatable relative to the discharge housing, and pivoting the body and the discharge grate to the horizontal position and in response thereto, rotating the body and discharge grate about the longitudinal axis, wherein the discharge grate rotates relative to the discharge housing. The method further includes discharging milled product through the plurality of holes into the discharge housing during rotation of the body and the discharge grate.

In one approach, the discharge grate is sealed to the discharge housing via an annular seal and the discharge grate includes a deflector portion disposed radially inward of the annular seal, the method further comprising deflecting milled product away from the annular seal via the deflector portion.

DETAILED DESCRIPTION

Figure 1:
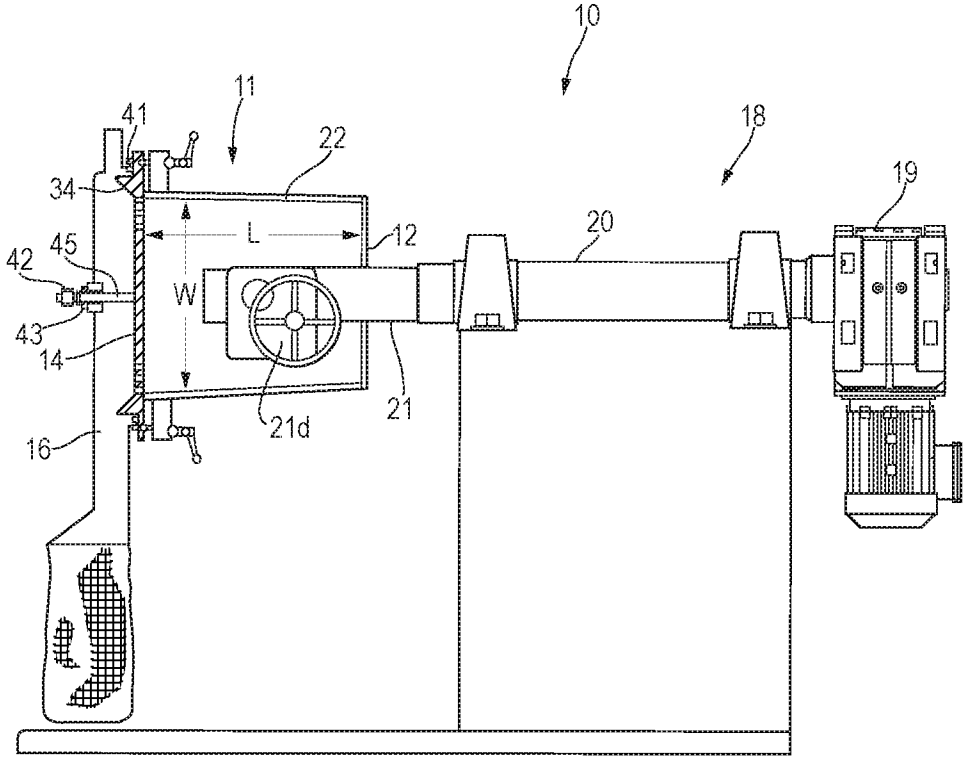
FIG. 1 is a front view of rotary mill system having a body with an opening at one end, a discharge grate removably attached to the body over the opening, a discharge housing attached to the discharge grate, and a drive system for rotatably driving the body.

Referring now to the drawings, FIGS. 1-8 illustrate a rotary mill system 10 for milling a desired product. As shown in FIG. 1, the system 10 includes a rotatable body 11, in which grinding media 28 are disposed. The body 11 includes a closed end wall 12 at one end and an opening 13 at the opposite end from the end wall 12. Milled product can be recovered from within the body 11 through the opening 13 after the product has been sufficiently milled.

In one approach, the body 11 has a tapered frustoconical shape, such that the diameter of the body 11 at the opening 13 is greater than the diameter of the body 11 at the closed end wall 12.

A discharge grate 14 having a generally circular profile is disposed over the opening 13 of the body 11. The discharge grate 14 is removably attachable to the opening 13 of the body 11. During the milling of the product within the body 11, the discharge grate 14 is removed from the body and replaced with a cover 50. The discharge grate 14 is attached to the body 11 during discharge of the milled product, which will be further described below. The discharge grate 14 remains in place during discharge in order to retain the grinding media within the body 11, and to allow the milled product to exit through the grate 14. During rotation of the body 11 during the discharge process, the discharge grate 14 rotates along with the body due to its attachment to the body 11.

The system 10 further includes a discharge housing 16 that remains in a fixed position during the discharge process. Put another way, the discharge housing 16 does not rotate. The discharge housing 16 is arranged to cooperate with the discharge grate 14 during the discharge process, such that the discharge grate 14 will engage with the discharge housing 16 in a sealing manner. The discharge grate 14 will contact the discharge housing 16 generally throughout the rotary process, with the discharge grate 14 rotating relative to the fixed discharge housing 16. As further described below, the milled product will pass through the discharge grate 14 into the discharge housing 16.

The system 10 further includes a drive system 18 for driving the body 11 rotationally to perform the rotary milling process. The drive system 18 includes a motor 19 that preferably includes a gear reducer, although other rotational drive systems can also be used. The drive system 18 further includes a drive shaft 20 coupled to the motor 19 that is rotationally driven by the motor 19. The drive shaft 20 is coupled at the end opposite the motor 19 to a support yoke 21 that extends over diametrically opposite sides of the body 11, and is attached to the body 11 such that rotation of the drive shaft 20 and yoke 21 will cause a corresponding rotation of the body 11.

Figure 5:
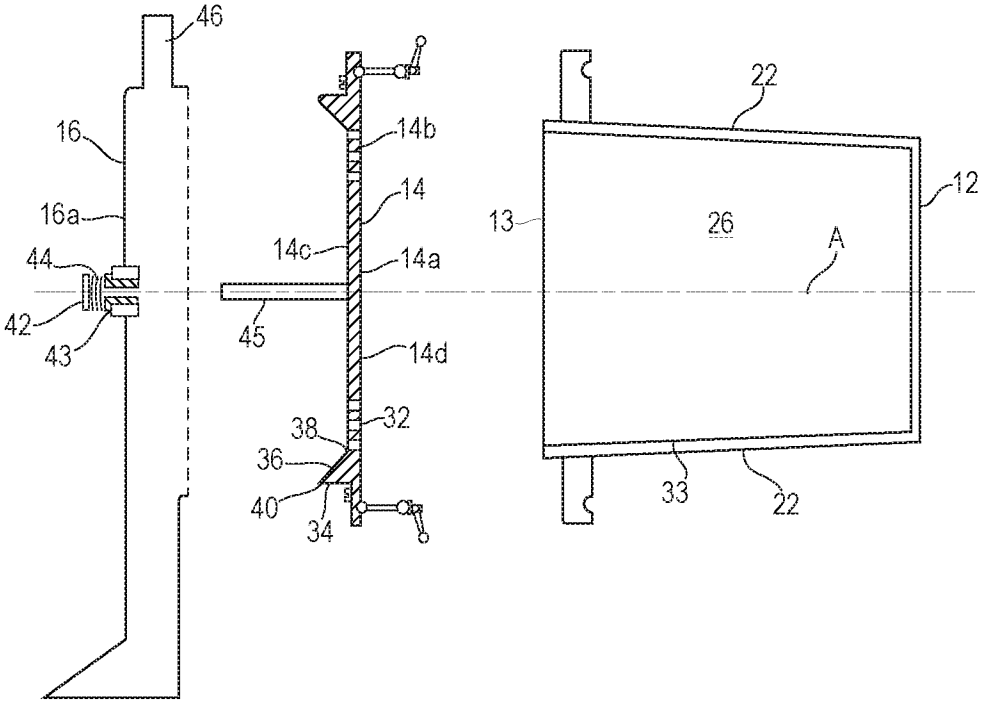
FIG. 5 is a front exploded view of the body, the discharge grate, and the discharge housing.
Figure 7:
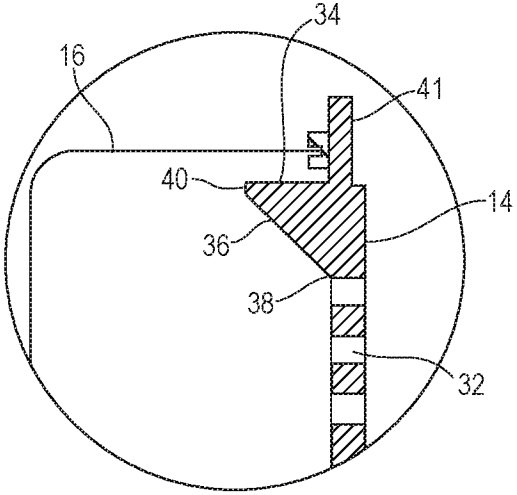
FIG. 7 is a view of an annular seal between the discharge grate and the housing that allows the discharge grate to rotate relative to the housing.

With reference to FIG. 5, the body 11 includes a sidewall 22 extending between the end wall 12 and the opening 13. The sidewall 22, end wall 12, and opening 13 combine to define a cavity 26 within the body 11 having a longitudinal central axis A. The cavity 26 is generally closed at the opening during discharge by way of the discharge grate 14 attached to and covering the opening 13. The body 11 generally includes the grinding media 28 (FIG. 6) disposed within the cavity 26 for performing a rotary milling operation. The amount of grinding media 28 depends on the needs of the user. For example, the cavity 26 could be approximately 50% full of grinding media 28 by volume. Of course, other amounts, such as 30-60%, could also be used.

The grinding media 28 may be any suitably hard material, such as carbon steel, stainless steel, tungsten carbide, alumina, zirconia, porcelain, or the like. The grinding media can have different sizing as necessary. For example, in one form, the grinding media can be between ¼ inches in diameter to 1 inch in diameter. Of course, it could also be as small ⅛ inch or as large as 3 inches in diameter. The grinding media 28 is preferably a uniform size; however, the media size used in a particular operation could be different, where some of the media could be, for example, 1 inch in diameter with others being 2 inches in diameter. These sizes are merely exemplary and it will be appreciated that various other sizes of the grinding media could also be used. The grinding media 28 are preferably in the form a spherical shape, but may be other shapes, such as a cylinder or block.

With reference again to the sidewall 22, in one approach, the sidewall 22 may be referred to as "conical" although it does not fully define a cone shape, and instead has a frustoconical, tapered, sloping, or variable diameter shape. It will be appreciated that reference to any one of these shape descriptions can refer to these other shape descriptions. The conical shape has a first diameter that generally conforms to the diameter at the opening 13. The diameter of the conical shape decreases as it extends away from the opening 13 and toward the end wall 12, such that the conical shape can also be referred to as a variable diameter.

The diameter of the conical shape can generally decrease at a constant rate, such that it defines a generally constant slope or taper between the opening 13 and the end wall 12. The diameter of the end wall 12 generally conforms to the diameter of the conical shape at the interface between the sidewall 22 and the end wall 12. Accordingly, the diameter of the body 11 at the end wall 12 is smaller than the diameter of the body 11 at the opening 13.

The shape of the body 11 in this arrangement therefore defines an inner sloped surface 33 that slopes from the end wall 12 toward the opening 13. Accordingly, the inner sloped surface 33 also slopes toward the discharge grate 14 that covers the opening 13, and toward the discharge housing 16 that is coupled to the discharge grate 14.

The above description refers to the arrangement of the body 11 when the longitudinal axis A of the body 11 is oriented horizontally. As further described below, the body 11 can be pivoted to another position where the axis A is oriented vertically. The milling process and discharge process are performed when the body 11 is oriented horizontally. The vertical orientation is typically used for removal of grinding media or addition of grinding media and/or product to be milled, and for changing between a first configuration where the cover 50 is attached to body 11 and a second configuration where the discharge grate 14 is attached to the body.

In one approach, the length L of the body 11 along the axis A is greater than the width W of the body 11, both at the opening 13 and at the end wall 12. However, in another approach, the length of the body 11 could be less than the diameter of the opening 13 and the end wall 12, or the length could be less than the diameter of the opening 13 and greater than the diameter of the end wall 12.

As described previously above, the body 11 is generally arranged and supported horizontally during the milling and discharge process. Accordingly, the sloped shape of the body 11 will cause the grinding media 28 and milled product housed within the body 11 to be urged toward the opening 13 due to gravity, as well as due to the centrifugal forces that occur during rotation, where the radial outward force combines with the slope of the body 11 to urge the milled toward the opening 13 of the body 11. With the opening 13 and discharge grate 14 disposed at one end of the body 11, the milled product is therefore urged toward the discharge grate 14 as a result of the sloped shape. In one approach, the slope or taper of the body 11 is about 2 degrees. It has been found that a slope or taper of about 2 degrees is sufficient to generally eliminate reliance on "random walk" and enough to cause the milled particles to move in the direction toward wider diameters. Because of the sloped shape of the body 11, gravity acting on the particles is not normal to the inner surface as it is in horizontally oriented inner surfaces of pure cylinders.

With the grinding media and milled product being urged toward the discharge grate 14, the grinding media and milled product will migrate toward the discharge grate 14 more easily, and will have less reliance on "random walk" to reach the discharge grate 14 relative to a cylindrical body shape.

The body 11 has been described as creating a generally constant slope toward the cylindrical portion 29. However, it will be appreciated that the body 11 can also have a generally curved profile, such that the slope is variable and defining a generally curved shape, with the slope being different at different longitudinal locations. The shape of the body would therefore not be frustoconical, but would still be a variable diameter with a variable slope and a curved profile. The profile could be curved to define a concave shape within the cavity 26 of the body 11, or it could have a generally complex curvature where the slope both increases and decreases along the longitudinal axis. However, for the purposes of discussion, the body 11 will be described as having a generally constant slope along their lengths.

The degree of the slope or angle of the conical shape is preferably selected such that the change in linear velocity along the sidewall 22 near the end wall 12 does not differ too much relative to the linear velocity near the opening 13. Because the body 11 is rotated at a selected speed, the resulting linear velocity at the sidewall 22 near the opening 13 having a larger diameter is greater than the linear velocity at the sidewall 22 near the end walls 12, which has a smaller diameter. These velocities near the sidewall 22 can be referred to as the "critical speed." The angle or slope of the sidewall 22 of the body 11 is preferably selected such that the difference in critical speed at the opening 13 relative to the end wall 12 is between about 1% and 10%, in order to limit the effect on milling dynamics. In one approach, the angle or slope of the sidewall 22 is about 2 degrees. This approach has only a nominal effect on the critical speed, but is enough to eliminate the need for "random walk" and to move particles in the direction of the wider portions of the body.

Rotary ball mills typically operate at a percentage of their critical speed, which generally depends on three variables: the diameter of the milling body or cylinder, the rotational speed of the body or cylinder, and to a lesser extent the diameter of the grinding media 28. The critical speed is the speed described in revolution per minute at which the first layer of grinding media 28 will centrifuge against the sidewall of the mill body 11, rendering the grinding media relatively motionless relative to the rotating body. This condition is typically referred to as the first critical speed and acts as the basis for determining operational mill speeds. The second critical speed occurs where two layers of grinding media are rendered motionless relative to the rotating body. When the mill body or cylinder speed is sufficiently fast to centrifuge all of the grinding media to the sidewall, no movement of the grinding media 28 relative to the body 11 or cylinder is taking place, and therefore no grinding is taking place. This condition is typically referred to as the Nth critical speed. In order for grinding media to move in a cascading and tumbling action inside the mill body or cylinder, mills generally operate at between 50-70% of the first critical speed, although speeds as low as 20% of the critical speed and as high as 90% of the critical speed are also possible.

Critical speed can be expressed via the following formula:

$$CS = \frac{1}{2\pi}\sqrt{(g/R - r)},$$

where CS is Critical Speed, g is a gravitational constant, R is the radius of the mill, and r is the radius of one piece of grinding media.

Because the end wall 12 of the body 11 is smaller in diameter than at the opening 13, the critical speed is higher, because the smaller diameter requires a faster rotational speed to achieve the same centrifuging of the first layer of grinding media 28. Accordingly, grinding media will tumble less energetically at the end wall 12 of the body 11 than at the opening 13.

Accordingly, it is preferable for the diameters of the opening 13 and the end wall 12 to remain dimensionally close, yet with a difference that is large enough to create enough of a slope to allow milled product to sufficiently flow toward the discharge grate 14. In one approach, the slope or taper of the body 11 is about 2 degrees.

By way of example, the change in critical speed for different tapers will now be discussed. A rotary mill body with a 72 inch diameter in the center and 1 inch diameter grinding media has a critical speed of approximately 31.5 rpm. For a taper 1 degree from horizontal, the critical speed at the end 12 of the mill is about 31.8 rpm (where the end 12 has a diameter of about 70.62 inches). For a taper 2 degrees from horizontal, the critical speed is about 32.1 rpm (where the end 12 has a diameter of about 69.23 inches). For a taper 3 degrees from horizontal, the critical speed is about 32.5 rpm (where the end 12 has a diameter of about 67.84 inches). For a taper 4 degrees from horizontal, the critical speed is about 32.8 rpm (where the end 12 has a diameter of about 66.45 inches). For a taper 5 degrees from horizontal, the critical speed is about 33.2 rpm (where the end 12 has a diameter of about 65.06 inches). For a taper 6 degrees from horizontal, the critical speed is about 33.5 rpm (where the end 12 has a diameter of about 63.66 inches). For a taper 7 degrees from horizontal, the critical speed is about 33.9 rpm (where the end 12 has a diameter of about 62.26 inches). For a taper 8 degrees from horizontal, the critical speed is about 34.3 rpm (where the end 12 has a diameter of about 60.85 inches). Thus, even at an 8 degree taper from horizontal, the difference in critical speed is about 8.9% relative to no taper.

By way of further example, with reference to a 2 degree taper, if the body 11 is operated at about 60% of critical speed at the opening of the mill (72 inch diameter), this would be about 18.9 rpm. With a 2 degree taper, the reduced diameter end of the body 11 would be about 69.23 inches. To match the performance at the end to the performance of the opening, the body 11 would need to rotate at 19.28 rpm. However, the opening and the end will have the same rpm during rotation. Thus, the end will rotate at 18.9 rpm if the rotation speed of the body 11 is set according to 60% of the critical speed of the opening. Thus, the percentage difference of 18.9 actual rotational speed to 19.28 rpm "desired" speed is about 2%, so the end is rotating at about 2% below the "desired" speed. It will be appreciated that "desired" refers to the speed where the performance at the end would match the performance at the opening and that operating at the same rotational speed as the opening is not undesirable.

Other differences relative to 18.9 rpm for different tapers to match the performance of 18.9 rpm are as follows: 1 degree, 19.09 rpm; 3 degrees, 19.48 rpm; 4 degrees, 19.69 rpm; 5 degrees, 19.90 rpm; 6 degrees, 20.12 rpm; 7 degrees, 20.35 rpm; and 8 degrees, 20.59 rpm.

Generally, it is preferable to operate a mill within 5% of its expected speed due to outside factors affecting the actual rpm. Thus, the difference of 2% of a 2 degree taper is within that range. Accordingly, the taper of the body 11 is preferably in the range of 1-5 degrees. However, tapers outside this range could also be used if desired by the user.

The tapers illustrated in the Figures are for illustrative purposes and may be exaggerated relative to the tapers used in practice. The purpose of the illustrated taper is to clarify that the body 11 is not cylindrical in this approach and includes the body 11 having an end with a diameter that is smaller than the opening 13.

The system 10 has been described as having a conical-shaped body 11. The advantages of a conical shaped body have been described above. However, the system 10 could also function when the body 11 has a pure cylindrical shape, where the diameters at each end of the body 11 are the same or approximately the same, and there is generally no slope of the inner surface of the body 11. In this approach, milled product can still be discharged through the discharge grate 14, but will do so without the aid of gravity and with some reliance on "random walk" of the milled product across the body 11 toward the discharge grate 14.

Having described the body 11, the associated structure for rotating and supporting the body 11 and discharging the milled product will now be described in further detail.

Figure 3:
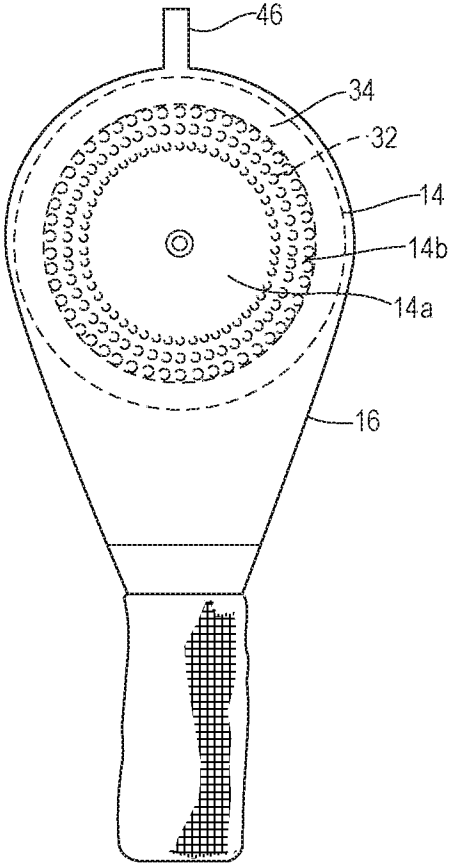

Referring once again to the discharge grate 14 and in particular to FIG. 3, the discharge grate 14 has a circular shape and is removably attached to the body 11 over the opening 13, as described above. The discharge grate 14 further includes an inner portion 14*a* and an outer portion 14*b*, where the inner portion 14*a* is located radially inward from the outer portion 14*b*. The inner portion 14*a* has a generally circular shape, and the outer portion 14*b* has a ring-like shape that extends circumferentially around and radially surrounds the inner portion 14*a*.

The inner portion 14*a* is generally solid, such that milled product of grinding media will not be able to pass through the inner portion. The outer portion 14*b* is perforated, such that milled product may pass through the perforations, while grinding media is prevented from passing through the perforations. The perforations may be in the form of circular holes 32. In another approach, the holes 32 could have other shapes. The holes 32 are sized such that the opening defined by the holes is smaller than the size of the grinding media, thereby preventing the grinding media from passing through the outer portion 14*b*.

The holes 32 may be arranged in circumferential rows that extend around the circumference of the outer portion 14*b*. In another approach, the holes 32 may be arranged in a radial spoke-like arrangement, such that multiple holes are aligned at the same angle at each "spoke." In another approach, the holes 32 may be arranged in a random pattern. The holes 32 can be spaced from each other in a generally constant manner, such that the distance between the centers of the holes is approximately the same between all holes, or between the holes forming each row. In another approach, the holes 32 can be spaced from each other at differing spacing.

The holes 32 are arranged in the outer portion 14*b* of the discharge grate, such that when the discharge grate 14 is attached to the body 11 to cover the opening 13, the holes 32 are adjacent the radial edge of the opening 13. Thus, when the body 11 is oriented horizontally, the bottom of the opening 13 will be laterally adjacent the holes 32. Thus, milled product that is urged toward the opening 13 and at the bottom of the body 11 due to gravity will exit the cavity 26 of the body 11 through the holes 32. Milled product that is located above the holes 32 will not pass through the inner portion 14*a*, and will instead pass through the holes 32 when the milled product has moved radially outward such that it becomes laterally adjacent the holes 32. Preferably, the outermost holes 32 are arranged such that their outer edge is aligned with the outer edge of the opening 13. Thus, milled product that is contacting the bottom of the body 11 and that has been urged toward the opening 13 will pass through the holes 32 and not become trapped against the interface between the edge of the opening 13 and the discharge grate 14. In one approach, the openings of the holes 32 may overlap the edge of the opening 13 to increase the open area at the interface between the grate 14 and the edge of the opening 13.

Milled product will typically exit from the bottom of the body 11 during the discharge process. However, milled product can also exit from the top of the body 11 because of the presence of the holes 32. In another approach, the discharge grate 14 may also include holes in the inner portion 14*a*, such that holes will cover the majority of the discharge grate 14. However, because the milled product will typically exit from the bottom of the body 11, holes in the middle or inner portion of the discharge grate 14 may be excluded.

With reference to FIGS. 3 and 5, the discharge grate 14 may further include a deflector portion 34 that extends outward from a discharge side 14*c* of the discharge grate 14. The discharge side 14*c* is the side of the grate 14 that faces the discharge housing 16. A body side 14*d* of the discharge grate faces into the body 11, and is the side that contacts the grinding media.

The deflector portion 34 may be integrally formed with the discharge grate 14, or it may be one or more separate components that are attached to the discharge side 14*c* of the grate 14. The deflector portion 34 has an annular or ring-like shape that extends circumferentially around the holes 32 and is disposed radially outward relative to the holes 32. Thus, the deflector portion 34 is also disposed on the outer portion 14*b* of the grate 14.

The deflector portion 34 has a tapered profile or wedge-like profile in cross-section, such that it includes an angled surface 36 that extends radially outward and longitudinally away from an inner edge 38 of the deflector portion 34 that intersects the surface of the discharge grate 14. The angled surface 36 may also be curved or convex or concave. The longitudinal thickness of the deflector 34 increases as it extends radially outward toward its outer edge 40.

Figure 6:
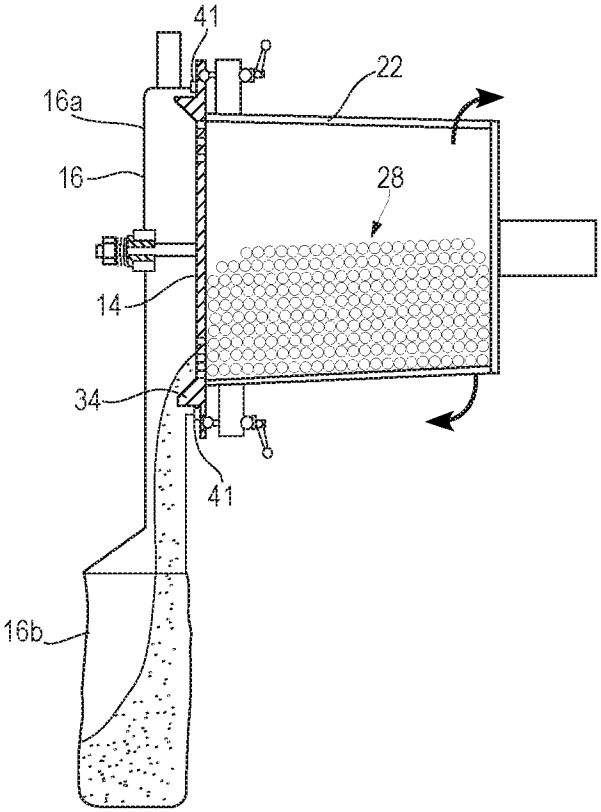
FIG. 6 is a front view of the system illustrating a rotary discharge process, with grinding media disposed within the body, and milled product being discharged through the holes in the discharge grate into the discharge housing.

With reference to FIG. 6, during discharge, the deflector 34 directs milled product longitudinally away from the discharge grate 14. The deflector 34 further directs milled product away from the sealing interface between the discharge grate 14 and the discharge housing 16, to keep the seal relatively free from contact with the milled product and the fine dust or particles associated with the milled product. As the milled product exits the through the holes 32, gravity will tend to cause the milled product to drop straight down, but the deflector 34 urges it laterally away from the discharge grate 14 as well as the sealing interface between the grate 14 and the discharge housing 16. As described above, the milled product will typically exit from the bottom of the body 11 when the body 11 is rotated, and likewise will pass over the bottom of the annular shaped deflector 34 that rotates along with the body 11. Of course, it will be appreciated that the rotation of the body 11 and discharge grate 14, including the deflector 34, will result in the full circumference of the deflector 34 coming into contact with the milled product, because individual locations around the full circumference will become the "bottom" as the grate 14 is rotated.

As described above, the discharge grate 14 rotates relative to the discharge housing 16, which remains stationary. Further, the grate 14 is sealed to the discharge housing 16 to limit or prevent milled product from escaping outside of the discharge housing 16 as it is discharged from the body 11 through the discharge grate 14. Thus, the discharge grate 14 and the discharge housing 16 combine to define an annular seal 41 at the interface between the discharge grate 14 and the discharge housing 16.

In one approach, the seal 41 is in the form of a UHMW labyrinth seal. This seal 41 allows the discharge grate 14 to rotate relative to the stationary discharge housing 16, while retaining the milled product within the discharge housing 16. However, due to the rotation of the discharge grate 14 relative to the housing 16, the surfaces that contact each other to define the seal 41 will likewise move relative to each other. Thus, the deflector 34 will aid in limiting or preventing milled product from coming into contact with the seal 41, thereby limiting wear and potential damage to the seal 41 that could be caused by milled product or debris becoming lodged in the sealing interface.

In one approach, as shown in FIGS. 5 and 6, the discharge housing 16 may be attached to the discharge grate 14 in a biased manner, such that the discharge housing 16 is biased toward the discharge grate 14. The discharge housing 16 may include an upper portion 16*a* that is generally rigid and having a fixed shape, as well as a lower portion 16*b* that may be in the form of a flexible collection bag or other container. The lower portion 16*b* may be removably attached to the upper portion 16*a*. The upper portion 16*a* can include the structure for mounting or attaching the discharge housing 16 to the discharge grate 14.

Figure 2:
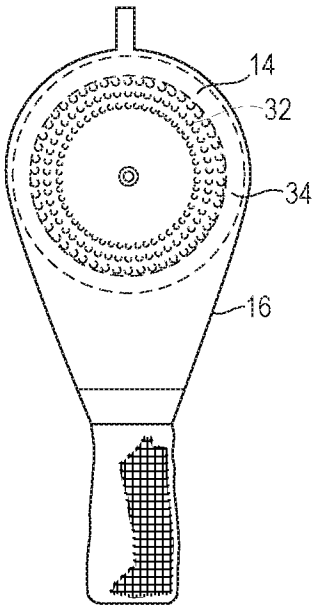
FIGS. 2 and 3 are left side views of the system illustrated in FIG. 1, illustrating the discharge housing and holes disposed through the discharge grate for allowing milled product to pass through the grate and into the housing.

The upper portion 16*a* can have a circular shape that is slightly larger in diameter than the discharge grate 14, and can include a tapered portion that tapers down toward the interface with the bottom portion 16*b*, as shown in FIG. 2. The upper portion 16*a* may include a central bearing 43 that defines an opening centered along the longitudinal axis A when the discharge housing 16 is attached to the discharge grate 14. The bearing 43 may in the form of a UHMW bushing seated within a bearing attached to or formed by the upper portion 16*a*. Accordingly, the bushing can rotate relative to the bearing.

The discharge grate 14 may include a shaft 45 that extends longitudinally away from the center of the discharge grate 14 and into the housing 16, and further through the bearing 43. The end of the shaft 45 may include a nut 42 attached to an outer end of the shaft 45, and a spring 44 or other biasing member, such as a Belleville spring, can be disposed between the nut 42 and the bearing 43. The spring 44 will bias the discharge housing 16 toward the discharge grate 14. This biasing force aids in keeping the discharge housing 16 sealed against the discharge grate 14, while not being too large of a force such that the discharge grate 14 would be overly restricted in rotating relative to the stationary discharge housing 16.

The discharge grate 14 will therefore remain attached to and sealed to the discharge housing 16 during rotation of the body 11 and the discharge grate 14. Discharge of the milled product will proceed through the holes 32 in the grate 14 as the body 11 is rotated, and the milled product will pass over the deflector 34 and be directed away from the seal 41. Milled product will then fall into the lower portion 16*b* of the discharge housing 16. Upon completion of the discharge process, the lower portion 16*b* can be removed from the upper portion 16*a* for further processing, and a new lower portion may be attached to receive further milled product in a subsequent discharge operation.

The discharge housing 16 may further include a dust collection port 46 disposed at the top of the upper portion 16*a*. The dust collection port 46 may be operatively coupled to a vacuum source (not shown) to draw out fine dust during or after the discharge operation, while allowing larger particles to drop into the lower portion 16*b*.

The above description has generally referred to the components involved during the discharge process, with the body 11 arranged horizontally. The body 11 is also arranged horizontally to perform the milling process.

While the milling process could be performed with the discharge grate 14 attached to the body 11, and the discharge grate 14 attached to the discharge housing 16, this could result in milled product that is inconsistently sized, such that some particles will be larger and pass through the holes 32 once they are small enough, while other particles remained in the body 11 for a longer period of time and become smaller prior to discharge. Further, to aid in the discharge, the holes 32 are preferably made larger than the target particle size to allow for efficient discharge, but the result is that larger than desired particles could pass through the holes early. Thus, it may be desirable to perform the milling process separately from the discharge process.

Figure 8:
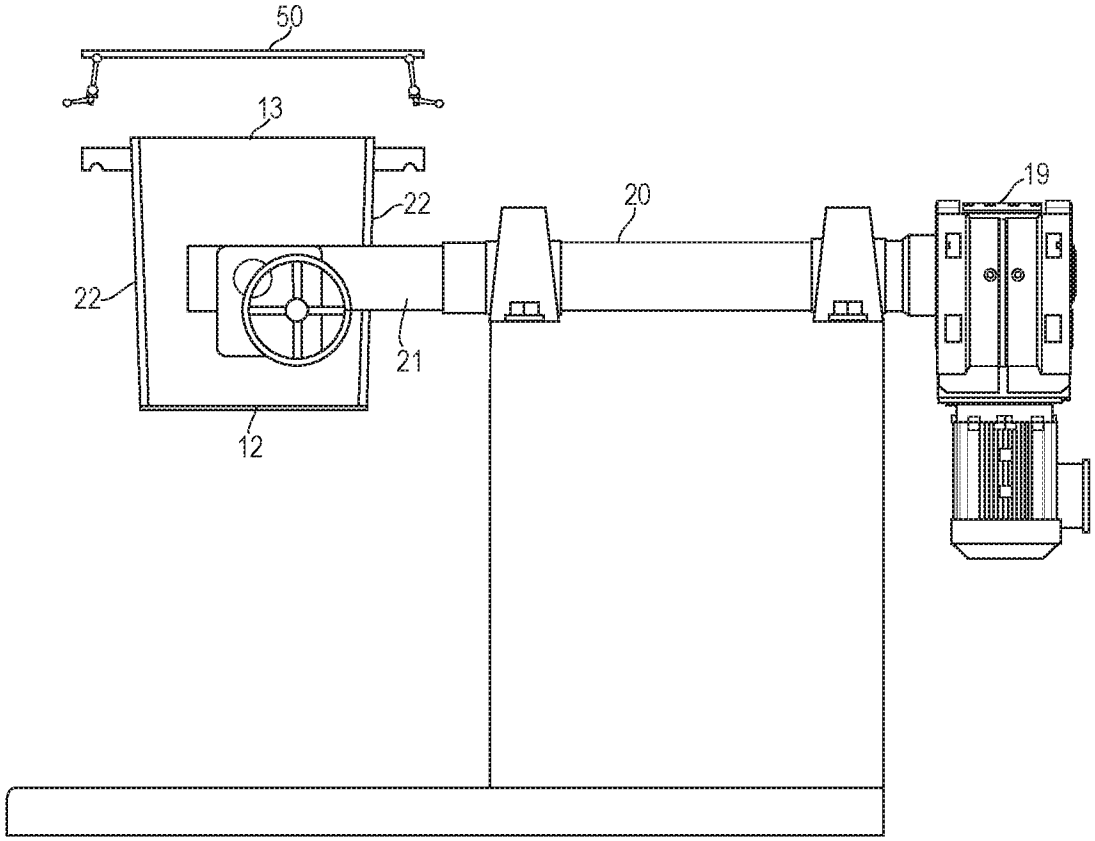
FIG. 8 is a front view of the system in a vertical orientation, with the body pivoted relative to the yoke, and the discharge grate replaced by a solid cover for using during a milling procedure.

With reference to FIG. 8, to perform the discharge process separately from a previously performed milling process, the system 10 may further include a solid cover 50. The solid cover 50 may be sized similarly to the discharge grate 14, and may be attachable to the body 11 in the same manner as the discharge grate 14. The solid cover 50, like the discharge grate 14, may be circular in shape. Unlike the discharge grate 14, the solid cover 50 does not include any holes, nor does it include any deflector, because milled product is not intended to pass through the solid cover 50. On the contrary, the solid cover 50 retains both the grinding media and the milled product within the body 11. The solid cover 50 need not be attachable to the discharge housing 16, because no discharge occurs when the solid cover 50 is installed on the body 11. FIG. 8 illustrates the body in a vertical orientation, where the solid cover 50 and discharge grate 14 may be exchanged. The horizontal orientation illustrated in the other Figures would apply to the orientation of the body 11 when the cover 50 is attached and milling is occurring.

Once the rotary milling process is complete, the solid cover 50 may be exchanged for the discharge grate 14. However, due to the horizontal orientation of the body 11 and the opening 13 at the side, removal of the cover 50 while the body 11 is horizontal would result in the grinding media and the milled product being dumped out of the body 11. Thus, the orientation shown in FIG. 8 is the desired orientation for exchanging the grate 14 for the cover 50, and vice versa.

Thus, the system 10 is designed so that the body 11 is pivotable such that the opening 13 is disposed at the top of the body 11, and the axis A is vertically aligned. It will be appreciate that a true vertical orientation would not be necessary to retain the grinding media and milled product and exchange the grate 14 and cover 50.

Figure 4:
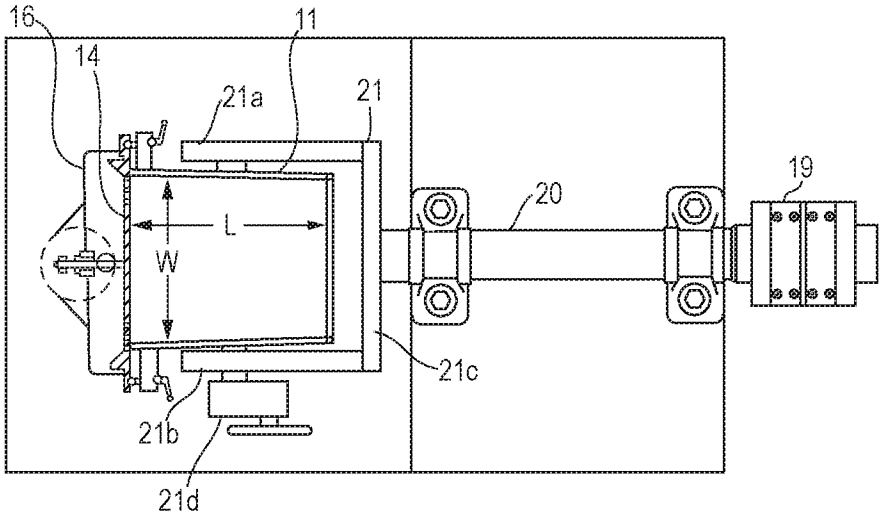
FIG. 4 is a top view of the system, illustrating a support yoke for allowing the body to pivot relative to the yoke.

As described previously, the body 11 is attached to the drive system 18 that includes the drive shaft 20 and the yoke 21. As shown in FIG. 4, the yoke 21 includes a pair of arms 21*a* and 21*b* that extend horizontally to opposite sides of the body 11. The body 11 is attached in a rotational or pivotal manner to each of the arms 21*a* and 21*b* of the yoke 21. The arms 21 and 21*b* are attached to each other via a connecting bar 21*c* that extends between corresponding ends of the arms 21*a* and 21*b*. The ends of the arms 21*a* and 21*b* that are opposite the ends that attach to the connecting bar 21*c* are the ends that attach to the body 11. The connecting bar 21*c* is attached to the end of the drive shaft 20 that is opposite the end of the drive shaft 20 that is connected to the motor 19 that rotationally drives the drive shaft 20.

The coupling between the body 11 and the arms 21*a* and 21*b* can be in the form of any known rotational coupling. For example, a cylindrical post can extend radially away from the body 11 on each side, with the posts being received in corresponding circular openings in the arms 21*a* and 21*b*. Thus, the body 11 may be selectively rotated or pivoted relative to the arms 21*a* and 21*b*. The body 11 can be selectively pivotable or locked relative to the arms 21*a* and 21*b* in a manner known in the art.

In one approach, the connection between the body 11 and one of the arms 21*a* and 21*b* can include a gear reducer 21*d* to aid in rotating the body 11 relative to the yoke 21. The gear reducer 21*d* can be operated automatically, via a motor, or manually.

To rotate the body 11 relative to the yoke 21 to orient the body 11 vertically, the arms 21*a* and 21*b* are preferably disposed at the same height relative to each other. Put another way, prior to pivoting the body 11, the arms 21*a* and 21*b* are rotated via the drive shaft 20 such that they are horizontally aligned. Thus, pivoting the body 11 relative to the yoke 21 will rotate the opening 13 upward. If the arms 21*a* and 21*b* were rotationally oriented such that they were vertically aligned, with one arm above the body 11 and the other arm below the body 11, pivoting the body 11 relative to the yoke 21 would result in the opening move to the side, and the opening would not move upward. Accordingly, it will be appreciated that the preferred orientation of the yoke 21 is such that the arms 21*a* and 21*b* are on horizontally opposite sides of the body 11, but that it would be possible to pivot the body 11 even if the arms of the yoke 21 were not exactly horizontally aligned. In some cases, it may be preferable to orient the arms 21*a* and 21*b* such that they are slightly misaligned horizontally, such that the opening 13 will be pointed upward and also slightly to the side, as long as the pivoted orientation of the body 11 is such that the opening 13 is directed upward enough that the grinding media and milled product will not spill out of the opening 13 when the cover 50 is removed.

Thus, the yoke 21 operates as part of the drive system 18 for rotating the body 11 about the longitudinal axis A, and also serves to allow the body to pivot about a pivot axis that is perpendicular to the axis A the extends through the connections between the yoke 21 and the body 11.

The gear reducer 21*d* can also function as a locking mechanism to prevent unintended rotation of the body 11 relative to the yoke 21. In another approach, additional locking mechanisms can be provided at the connection of the body 11 to the yoke 21 to prevent the body 11 from pivoting or rotating relative to the yoke 21. For example, during the milling process or the discharge process, the body 11 should remain fixed relative to the yoke 21, so that the body 11 will remain aligned horizontally to perform the milling or discharge. If the body 11 were to be unlocked and pivotable relative to the yoke 21 during the rotary milling and/or discharge, the weight of the body 11 and the grinding media and milled product therein would cause the body 11 to pivot or rotate relative to the yoke 21, which would be undesirable.

Given the above, the system 10 can have various positions and orientations during the loading, milling, and discharge operations.

To begin the overall procedure, the yoke 21 and drive shaft 20 are rotated such that the arms of the yoke 21 are generally aligned horizontally, such as the orientation shown in FIGS. 1 and 4. The body 11 is rotated relative to the yoke 21 such that the opening 13 is disposed at or near the top of the body 11 when the body 11 is oriented generally vertically, such as the orientation shown in FIG. 8. The cover 50 is not installed on the body 11, such that the opening 13 is open and loading of grinding media and product to be milled can be loaded into the top of the vertically oriented body 11. During loading, the body 11 is preferably in a locked position so that it will not inadvertently be allowed to rotate or pivot causing the contents of the body 11 to spill out. This position may be referred to as a vertical orientation or a loading position, and may also be referred to as the loading state.

Once the grinding media and milled product are deposited into the body 11, the cover 50 is attached to the opening 13. The cover 50 will close off and seal the cavity 26 of the body 11, thereby retaining the grinding media and product to be milled within the body 11. This may be referred to as the loaded state. In this state, system may still be referred to as being in the vertical orientation or the loading position, and can also be referred to as the vertical loaded position.

With the body 11 closed off and the grinding media and product to be milled being retained within the body 11 by the cover 50, the body 11 may be pivoted such that the body 11 is oriented horizontally, and the opening 13 with the cover 50 attached will be disposed to the side rather than the at the top. Prior to pivoting the body 11, the body 11 can be unlocked relative to the yoke 21, allowing it to be pivoted as intended. Once oriented horizontally, the body 11 can be locked once again to the yoke 21 to prevent the body from pivoting or rotating relative to the yoke 21. This position, with the body 11 being orientated horizontally, may be referred to as the horizontal orientation or the milling position. The grinding media and product to be milled will not spill out of the body 11 because the cover 50 is retaining the contents within the body.

With the body 11 oriented horizontally and locked relative to the yoke 21, the drive shaft 20, and the yoke 21 attached thereto, can be rotated to begin the milling process. The rotation of the drive shaft 20 and the yoke 21 will correspondingly cause the body 11 to rotate about axis A, causing the tumbling action of the grinding media within the body 11 as described above. This rotary milling occurs with the body 11 in the milling position. After a sufficient number of rotations at the desired rotational speed for the product, the milling will be complete, and rotation of the body 11 via the drive shaft 20 and the yoke 21 will be discontinued, with the body 11 coming to a stop.

With the milling complete, the yoke 21 can be further rotated such that the arms are aligned horizontally. The body 11 can then be unlocked relative to the yoke 21, and the body may be pivoted such that the opening 13 and cover 50 are disposed at the top of the body 11 in a position similar to or the same as the loading position, such as that shown in FIG. 8. The body 11 can then be locked once again relative to the yoke 21. This position can be referred to as the vertical orientation or a cover change position.

Once in the cover change position, the cover 50 may be removed from the body 11, thereby making the opening 13 open. With the opening 13 disposed at the top of the body 11, the contents of the body 11 will not spill out. With the cover 50 removed, the discharge grate 14 is attached over the opening 13. As described above, the discharge grate 14 includes the holes 32 around the perimeter for allowing the milled product to be discharged out of the body 11 during the discharge process. Accordingly, pivoting the body 11 to a horizontal orientation may result in some of the milled product escaping from the body 11 through the holes 32.

Thus, in a preferred approach, after the discharge grate 14 has been attached to the body 11 while the body 11 is in the vertical orientation, the discharge housing 16 may be attached to the discharge grate 14 with the body 11 and discharge grate 14 in the vertical orientation. The discharge housing 16 surrounds the discharge grate 14, such that milled product that escapes through the holes 32 will be retained in the housing 16.

After the discharge grate 14, and preferably the discharge housing 16, has been attached to the body 11, the body 11 can be unlocked from the cover change position and pivoted into horizontal orientation or discharge position. In the discharge position, the body 11 is oriented horizontally, similar to the milling position. Once in the discharge position, the body 11 can be locked relative to the yoke 21.

In the discharge position, the discharge grate 14 is rotatable relative to the discharge housing 16, such that the housing 16 will remain fixed, and the body 11 and grate 14 attached thereto will be allowed to rotate relative to the fixed housing 16. Prior to rotation of the body 11 for discharging, the housing 16 can be oriented into a discharge orientation, where the lower portion 16*b* that collects the milled product that is discharged is disposed below the upper portion 16*a*, where the milled product initially enters the discharge housing 16. The discharge housing 16 may be fixed to the floor or other structure to maintain the discharge housing in a fixed position.

To discharge the milled product, the body 11 is rotated once again, in a manner similar to the milling process. The milled product will pass through the holes 32 into the discharge housing 16, and will be deflected away from the annular seal 41 between the housing 16 and the grate 14 via the deflector 34, and the milled product will fall into the lower portion 16*b* of the discharge housing 16. Continued rotation of the body 11 will cause the milled product to move toward the opening 13 and through the discharge grate 14, while the discharge housing 16 retains the grinding media.

Upon completion of the discharge process, the majority of milled product will be retained in the discharge housing 16, and the discharge housing 16 can be disconnected from the discharge grate 14. This disconnection preferably occurs prior to pivoting the body 11 again, to limit instances of milled product falling back into the body 11 through the holes of the discharge grate 14. However, it is possible to pivot the body 11 back to a vertical orientation prior to disconnecting the discharge housing 16, if desired. In one approach, the lower portion 16*b* of the discharge housing 16 is removed, with the upper portion 16*a* remaining attached to the discharge grate 14.

The body 11 is unlocked from the horizontal orientation and discharge position, and pivoted again with the opening 13 moving upward. The body 11 is therefore returned to the cover change position and vertical orientation. The discharge grate 14 can then be removed, and grinding media can be removed or added, as well as additional product to be milled. The cover 50 can be attached again, and the milling process, and subsequent discharge process, described above can be performed again.

As a person skilled in the art will readily appreciate, the above description is meant as an illustration of implementation of the principles this invention. This description is not intended to limit the scope or application of this invention in that the invention is susceptible to modification, variation, and change, without departing from the spirit of this invention, as defined in the following claims.

What is claimed is:

1. A rotary milling system for using grinding media to create a milled product, the system comprising:

a motor that drives a shaft having a longitudinal axis, with the shaft being connected to a rotatable body having a sidewall extending between first and second ends thereof, a first end wall at the first end, and an opening at the second end, the body defining a cavity and a central longitudinal axis that is coextensive with the longitudinal axis of the shaft, the rotatable body configured to retain grinding media therein;

a discharge grate detachably mounted to the second end of the body, the discharge grate covering the opening when mounted to the second end and rotationally fixed to the body and including a shaft extending longitudinally away from the discharge grate;

a plurality of holes passing through the discharge grate and configured to retain grinding media within the cavity of the body while allowing milled product to pass through the holes during rotation of the body about the central longitudinal axis;

a discharge housing attached to and biased against the discharge grate, the discharge housing configured to receive the milled product and including a bushing through which the shaft extends; and a spring extending between the shaft and the bushing to bias the bushing toward the discharge grate, wherein the discharge grate is rotatable relative to the discharge housing when the body is rotated about the longitudinal axis;

wherein the rotatable body is selectively rotatable about the longitudinal axis of the shaft and the rotatable body and selectively pivotable about a pivot axis that extends transverse to the longitudinal axis of the shaft and rotatable body such that in one position the central longitudinal axis is orthogonal to the longitudinal axis of the shaft;

wherein the rotatable body has a first orientation and a second orientation, the second orientation being pivoted about the pivot axis relative to the first orientation such that the opening is disposed upward relative to the first orientation.

2. The system of claim 1, wherein the central longitudinal axis is horizontal in the first orientation and vertical in the second orientation.

3. The system of claim 1, wherein the discharge housing and discharge grate define an annular seal.

4. The system of claim 1, wherein the discharge housing remains fixed during rotation of the body and discharge grate.

5. The system of claim 1 further comprising a removable solid cover, wherein the solid cover is attached to the body and covers the opening when the discharge grate is removed.

6. The system of claim 1 further comprising a support yoke attached to the rotatable body on opposite sides thereof.

7. The system of claim 6 wherein the drive shaft is coupled to the motor for being rotationally driven and coupled to the yoke and rotation of the drive shaft rotates the yoke and the rotational body attached thereto.

8. The system of claim 6, wherein the yoke is attached to the body via rotational bearings on opposite sides of the body, and the rotational bearings define the pivot axis such that the body is pivotable relative to the yoke.

9. The system of claim 8, wherein at least one of the rotational bearings is coupled to a gear reducer, wherein actuation of the gear reducer rotates the body about the pivot axis.

10. The system of claim 1, wherein the plurality of holes are disposed in a radially outer portion of the discharge grate.

11. The system of claim 1, wherein the discharge grate includes a deflector portion that extends longitudinally outward from the discharge grate away from the body, the deflector portion having an annular shape and disposed at a radially outward portion of the discharge grate and radially outward from the plurality of holes, wherein the deflector portion is disposed radially between the plurality of holes and an attachment interface defined between the discharge housing and the discharge grate for deflecting milled product away from the attachment interface.

12. The system of claim 11, wherein the deflector portion has a tapered profile, such that a height of the deflector portion from discharge grate is greater at a radially outward location than at a radially inward location.

13. The system of claim 1, wherein the sidewall has a tapered shape such that a diameter of the body at the end wall is smaller than the diameter of the opening, wherein rotation of the body about the longitudinal axis urges milled product toward the opening.

14. A method of operating a media grinding and discharge system including a rotatable body having a sidewall extending between first and second ends thereof, an end wall at the first end, and an opening at the second end, the body defining a cavity and a central longitudinal axis, the rotatable body configured to retain grinding media therein, wherein the body is pivotable about a pivot axis that is perpendicular to the longitudinal axis, the body being pivotable between a longitudinal horizontal position and a longitudinal vertical position, the method comprising:

pivoting the body to the vertical position and in response thereto, mounting a solid cover to the second end and covering the opening;

in response to mounting the solid cover, pivoting the body to the horizontal position, and in response thereto, rotating the body about the longitudinal axis to perform a grinding operation;

in response to performing the grinding operation, pivoting the body to the vertical position and removing the solid cover;

mounting a discharge grate to the second end after removing the solid cover, the discharge grate covering the opening when mounted to the second end and rotationally fixed to the body, wherein the discharge grate includes a plurality of holes passing through the discharge grate and configured to retain grinding media within the cavity of the body while allowing milled product to pass through the holes;

attaching a discharge housing to the discharge grate, wherein the discharge grate is rotatable relative to the discharge housing;

pivoting the body and the discharge grate to the horizontal position and in response thereto, rotating the body and discharge grate about the longitudinal axis, wherein the discharge grate rotates relative to the discharge housing; and discharging milled product through the plurality of holes into the discharge housing during rotation of the body and the discharge grate.

15. The method of claim 14, wherein discharge grate is sealed to the discharge housing via an annular seal and the discharge grate includes a deflector portion disposed radially inward of the annular seal, the method further comprising deflecting milled product away from the annular seal via the deflector portion.

* * * * *